US005340029A

United States Patent [19]

Adams

[11] Patent Number: 5,340,029

[45] Date of Patent: Aug. 23, 1994

[54] ROTARY SPRAY TIP ASSEMBLY WITH IMPROVED ROTOR SEALING MEANS

[75] Inventor: Robert J. Adams, Carol Stream, Ill.

[73] Assignee: Spraying Systems Co., Wheaton, Ill.

[21] Appl. No.: 42,556

[22] Filed: Apr. 5, 1993

[51] Int. Cl.[5] ..... B05B 15/02

[52] U.S. Cl. ..... 239/119; 239/288.3; 239/600

[58] Field of Search ..... 239/119, 288, 288.3, 239/390, 391

[56] References Cited

U.S. PATENT DOCUMENTS

| | | | |
|---|---|---|---|
| 3,202,360 | 8/1965 | O'Brien | 239/119 |
| 4,116,386 | 9/1978 | Calder | 239/119 |
| 4,165,836 | 8/1979 | Eull | 239/119 |
| 4,256,260 | 3/1981 | Piggott | 239/119 |
| 4,437,610 | 3/1984 | Huber et al. | 239/119 |
| 4,483,481 | 11/1984 | Calder | 239/119 |
| 4,484,707 | 11/1984 | Calder | 239/288.3 X |
| 4,508,268 | 4/1985 | Geberth, Jr. | 239/119 |
| 4,516,724 | 5/1985 | Hellman | 239/119 |
| 4,537,355 | 8/1985 | Calder | 239/119 |
| 4,611,758 | 9/1986 | Geberth, Jr. | 239/119 |
| 4,635,850 | 1/1987 | Leisi | 239/119 |
| 4,715,537 | 12/1987 | Calder | 239/119 |
| 4,757,947 | 7/1988 | Calder | 239/119 |
| 4,830,281 | 5/1989 | Calder | 239/119 |

FOREIGN PATENT DOCUMENTS

| | | | |
|---|---|---|---|
| 3513587 | 11/1985 | Fed. Rep. of Germany | 239/119 |

*Primary Examiner*—Andres Kashnikow
*Assistant Examiner*—Lesley D. Morris
*Attorney, Agent, or Firm*—Leydig, Voit & Mayer, Ltd.

[57] ABSTRACT

A reversible spray tip assembly having a housing formed with a longitudinal bore and a transverse bore, a cylindrical turret having a spray tip orifice rotatably and removably supported in the transverse housing bore, and a floating seal disposed in the longitudinal housing bore and having a concave sealing face adapted for sealing engagement with the turret. The spray tip assembly includes a seal adaptor disposed in the longitudinal housing bore upstream of the floating seal which, upon securement of the spray tip assembly onto a supply line by a threaded coupling, causes the seal to be forced into predetermined initial sealing contact with the turret regardless of how tightly the coupling is screwed onto the supply line.

14 Claims, 1 Drawing Sheet

ROTARY SPRAY TIP ASSEMBLY WITH IMPROVED ROTOR SEALING MEANS

FIELD OF THE INVENTION

The present invention relates generally to spray tip assemblies for airless spraying, and more particularly, to spray tip assemblies in which a spray tip orifice member is supported in a reversible and interchangeable turret.

BACKGROUND OF THE INVENTION

Reversible spray tip assemblies are known for use in high pressure, airless spraying. In such assemblies, an orifice tip is supported in a turret which may be rotated 180 degrees between spraying and cleaning positions and which is interchangeable with other turrets having orifice tips of different diameters and capacities for particular spray applications. For sealing the turret, a floating seal is provided which has a forward sealing face that conforms with the outer cylindrical contour of the turret.

While line pressure will force the floating seal into sealing engagement with the turret during high pressure spray operations, to prevent leakage during start up conditions an initial compressive loading must be applied to the seal. Such initial compressive loading typically is effected upon screwing a retainer nut of the assembly onto the barrel of a spray gun or like supply line with which the spray tip assembly is to be used. The tighter the retaining nut is screwed onto the spray gun, the greater the sealing forces that are transmitted to the seal, and in turn, to the turret. Secure engagement of the retaining nut onto the spray gun can cause the seal to exert such high forces against the turret, as to make it difficult to rotate the turret for a cleaning operation, or to remove and replace the turret. As a result, when securing the spray tip assembly onto the spray gun, the installer often turns the retaining nut with a wrench until it begins to feel tight, and then the turret is manually rotated. If the turret can be turned easily, the retaining cap can be tightened further to ensure secure engagement with the spray gun. If the turret is difficult to turn, the retaining nut is loosened. Such procedure is time consuming and the initial compressive loading of the seal against the turret is established by the subjective feel of the individual installer. Moreover, often optimum tightness cannot be easily achieved, and the installer must tightly screw the retaining nut on the spray gun and then later loosen it each time the turret is to be rotated and/or removed and replaced.

OBJECTS AND SUMMARY OF THE INVENTION

It is an object of the present invention to provide a reversible spray tip assembly for high pressure airless spraying which has an orifice tip supporting turret and which can be quickly and securely mounted on a spray gun or supply line with optimum initial compressive loading of the turret seal.

Another object is to provide a reversible spray tip assembly as characterized above which in response to tightening of a retaining nut for the assembly onto a spray gun or supply line the turret seal is caused to exert a predetermined, optimum initial sealing pressure on the turret, regardless of how tightly the retaining nut is secured to the spray gun or supply line.

Still another object is to provide a reversible spray tip assembly of the above kind that is relatively simple in design and easy to use.

Other objects and advantages of the invention will become apparent upon reading the following detailed description and upon reference to the drawings, in which:

FIG. 1 is a vertical section of a reversible spray tip assembly embodying the present invention mounted on the end of the barrel of a spray gun; and FIG. 2 is an enlarged fragmentary section depicting the spray tip assembly mounting and turret seal.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE DRAWING

Figure 1:
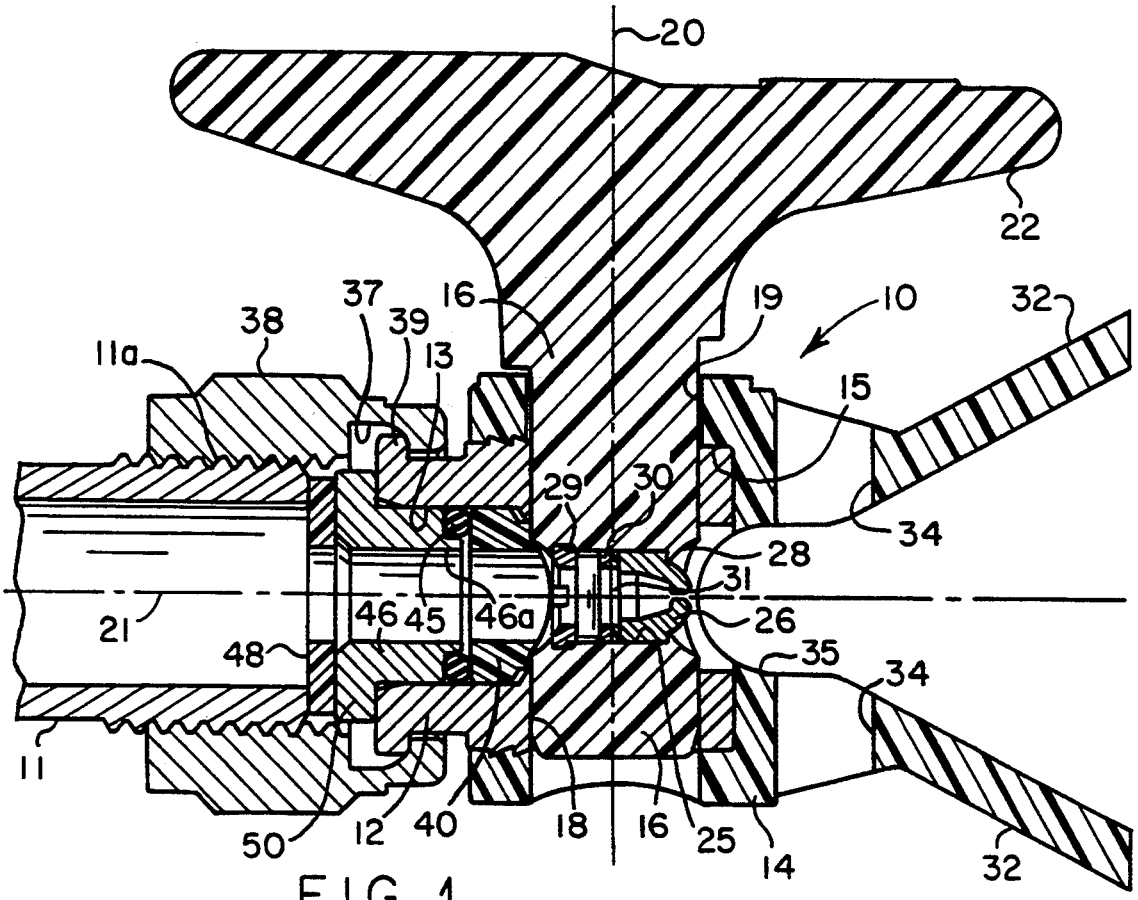
Figure 2:
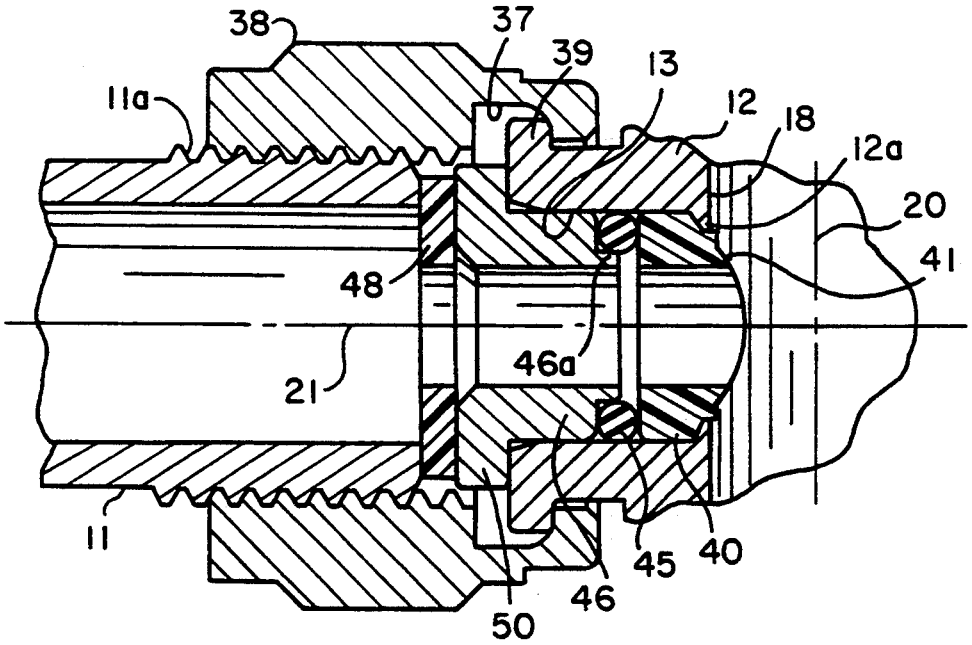

Referring now more particularly to the drawings, there is shown an illustrative reversible spray tip assembly 10 embodying the present invention mounted on the end of supply line, such as the barrel 11 of a conventional spray gun, for use in high pressure airless spraying. The spray tip assembly 10 includes a cylindrical housing 12 having a longitudinal bore 13, a guard 14 formed with an open-ended cylindrical cavity 15 in its upstream end for receiving a downstream end of the housing 12, and a turret supported within co-axial transverse bores 18, 19 of the housing 12 and guard 14, respectively, for rotation about an axis 20 perpendicular to the longitudinal axis 21 of the housing bore 13. The turret 16 has a handle 22 at an outwardly extending upper end to facilitate rotational movement of the turret 16, as well as removal and replacement thereof, as will become apparent.

The turret 16 has a transverse through bore 25 within which is supported an orifice tip 26 oriented in a downstream direction, as viewed in FIG. 1. The orifice tip 26, which preferably is made of wear resistant metal such as tungsten carbide, in this case is located against an annular lip 28 formed within the turret bore 25 such that a downstream end of the orifice tip 26 does not extend beyond the outer cylindrical plane of the turret 16. For securing the orifice tip 26 within the bore 25, an annular lock sleeve 29 is mounted in an upstream end of the bore 26 with annular gasket 30 interposed between the lock sleeve 29 and orifice tip 26. For diffusing a liquid flow stream directed through the annular lock sleeve 29, gasket 30, and orifice tip 26, a diffuser pin 31 is mounted transversely within the lock sleeve 29, being retained in opposing sidewall apertures in the lock sleeve 29.

For protecting the user of the spray tip assembly 10 from high pressure spray discharging from the orifice tip 26, the guard 14 has a pair of outwardly diverging wings 32, in this case each being formed with an aperture 34. The apex of the wings 32 define a U-shaped opening 35 to provide clearance for the spray discharging from the orifice tip 26.

In order to mount and secure the spray tip assembly 10 onto an externally threaded end **11*a* of the barrel 11, an internally threaded retainer nut 38 is coupled to the housing 12. The housing 12 has an outwardly extending radial flange 39 at its upstream end received within a downstream annular cavity 37 of the retainer nut 38 so as to permit relative rotation of the retainer nut 38 into threaded engagement with the barrel 11**.

For providing a seal against the turret 16 about the upstream side of the bore 25, a floating annular seal 40 is mounted within the housing 12 for limited axial movement. The seal 40 has a cylindrically concave face 41 adapted for mounting against the cylindrical contour of the turret 16. To seal the upstream end of the floating seal 40, an O-ring 45 is interposed between the upstream end of the seal 40 and a downstream end of an annular seal adapter 46 disposed within the cylindrical housing 12. In the illustrated embodiment, the downstream end of the seal adapter 46 has a forwardly extending annular lip 46*a* for supporting the O-ring 45 adjacent an outer periphery of the upstream face of the seal 40, such that the portion of the upstream face of the seal 40 radially inwardly from the O-ring 45 is directly exposed to line pressure for effecting pressure induced forces on the seal 40 against the turret 16 during high pressure spraying.

The seal adapter 46 has an upstream end extending outwardly of the housing 12 and a gasket 48 is interposed between the end of the seal adapter 46 and the downstream end of the barrel 11 upon which the spray tip assembly 10 is mounted. As the retaining nut 38 is threaded onto the barrel 11 during mounting of the spray tip assembly 10 on the spray gun or the like, axial forces are transmitted from the barrel 11 through the gasket 48, seal adapter 46, O-ring 45, and seal 40, causing the seal to be urged into contact with the turret 16. It will be understood by one skilled in the art that tightening of the retainer nut 38 in such manner will effect an initial biasing force of the seal 40 against the turret 16 to prevent leakage between the seal 40 and turret 16 when a liquid flow stream is initially directed through the flow passage defined by the gasket 48, seal adapter 46, O-ring 45, seal 40, and orifice tip 26, prior to the line pressure acting sufficiently on the upstream face of the seal 40 for effecting a high pressure seal. Heretofore, as indicated above, it has been difficult to determine how tightly the retaining nut 38 should be screwed onto the barrel nut 11 without urging the seal 40 against the turret 16 with such high force as to impede or prevent rotational movement of the turret and/or removal of the turret 16, as may be required.

In accordance with the invention, means are provided for limiting the initial biasing force of the floating seal against the turret to a predetermined optimum pressure for preventing start up leakage and for enabling easy rotational movement of the turret and/or removal and replacement thereof from the nozzle assembly, notwithstanding how tightly the retaining nut is secured to the barrel end. To this end, in the illustrated embodiment, the seal adapter 46 has an outwardly extending flange 50 which abuts the upstream end of the cylindrical housing 12 for limited downstream movement of the floating seal 40 to a set location for establishing a predetermined initial sealing pressure of the seal 40 against the turret 16. It will be seen by one skilled in the art that the flange 50 will limit the extent the seal adapter 46 can be forced into the cylindrical housing 12, notwithstanding how tightly the retaining nut 38 is screwed onto the barrel 11. As a result, the initial optimum sealing pressure can be established by the longitudinal lengths of the seal adapter 46 and seal 40 and the size and type of O-ring 45. Preferably, the initial sealing pressure is designed such that upon securing the spray nozzle assembly 10 onto the barrel 11 by tightening the retaining nut 38 with the flange 50 of the seal adapter 46 firmly against the upstream end of the housing 12, sufficient sealing pressure exists between the seal adapter 46, O-ring 45, seal 40 and turret 16 so as to prevent leakage when liquid is initially directed to the spray nozzle assembly, but yet is light enough to permit easy 180 degree rotation of the turret 16 between orifice tip spraying and cleaning positions, as well as easy removal of the turret 16 from the housing 12 and spray guard 14 during a changeover operation in which a different orifice tip and turret member are to be utilized.

To prevent ejection of the seal 40 into the bore 18 of the housing 12 upon removal of the turret 16, the internal wall of the housing 12 is formed with a small inwardly directed annular lip 12*a* adjacent the transverse bore 18, against which an annular shoulder of the orifice tip 26 engages. The annular lip 12*a* preferably limits protrusion of the downstream end of the seal 40 into the bore 18 to a relatively small distance upon removal of the turret. During normal usage, with the turret 16 positioned within the bores 18, 19, the concave surface 41 of the seal 40 engages the cylindrical contour of the turret 16 with a small spacing between the annular housing lip 12*a* and the seal 40, as shown in FIG. 1, so as to permit initial biasing of the seal 40 against the turret 16 upon tightening of the retaining cap 38 onto the barrel 11, as well as increased biasing of the seal 40 against the turret 16 when the seal is exposed to high line pressures during a spraying operation.

From the foregoing, it can be seen that the reversible spray tip assembly of the present invention is adapted for quick and secure mounting on spray guns or supply lines with optimum initial compressive loading on the turret seal. The spray tip assembly includes means responsive to tightening of the retaining nut of the assembly onto the spray gun or supply line for causing the turret seal to exert a predetermined, optimum initial sealing pressure on the turret, regardless of how tightly the retaining cap is secured to the spray gun. Yet, the reversible spray tip assembly is relatively simple in design and easy to use.

What is claimed is:

1. A spray tip assembly for mounting on the end of a liquid supply line for receiving pressurized liquid from said supply line and for discharging a liquid spray comprising a housing having a longitudinal bore and a transverse bore intersecting said longitudinal bore;

a threaded coupling for releasably securing said housing to a threaded end of said supply line for permitting communication of liquid from said supply line to said longitudinal housing bore;

a cylindrical turret rotatably and removably supported in said transverse bore and having a through bore that is positionable into aligned relation with said longitudinal housing bore;

means in said turret through bore defining a spray orifice from which a liquid spray discharges;

an annular floating seal slidably positioned in said longitudinal housing bore and having a cylindrically concave sealing face adapted for sealing engagement with said turret about an upstream side of said turret through bore;

means responsive to screwing said threaded coupling onto the threaded end of said supply line for effecting a predetermined initial biasing of said floating seal into sealing contact with said turret with a force that permits rotation of said turret relative to said housing and removal and replacement thereof regardless of how tightly the coupling is screwed onto the supply line; and said housing being formed with an annular lip extending inwardly into said longitudinal bore adjacent an upstream side of said transverse bore for limiting downstream longitudinal positioning of said seal in said longitudinal bore.

2. The spray tip assembly of claim 1 in which said orifice defining means is an orifice tip mounted in said turret through bore.

3. A spray tip assembly for mounting on the end of a liquid supply line for receiving pressurized liquid from said supply line and for discharging a liquid spray comprising a housing having a longitudinal bore and a transverse bore intersecting said longitudinal bore;

a threaded coupling for releasably securing said housing to a threaded end of said supply line for permitting communication of liquid from said supply line to said longitudinal housing bore;

a cylindrical turret rotatably and removably supported in said transverse bore and having a through bore that is positionable into aligned relation with said longitudinal housing bore;

means in said turret through bore defining a spray orifice from which a liquid spray discharges;

an annular floating seal slidably positioned in said longitudinal housing bore and having a cylindrically concave sealing face adapted for sealing engagement with said turret about an upstream side of said turret through bore;

a seal adapter located in said longitudinal housing bore upstream of said floating seal and having a portion extending outwardly of said housing on an upstream side thereof such that upon securing said housing to said supply line by said coupling an axial force is exerted on said seal adapter and in turn on said floating seal for biasing said floating seal into initial sealing engagement with said turret, and said seal adapter having an outwardly extending radial flange formed on the upstream end of said seal adapter for engagement with an upstream side of aid housing when said coupling is threaded onto said supply line for limiting to a predetermined amount the initial biasing force of the floating seal against said turret during securement of said housing to said supply line by said coupling so as to permit rotation of said turret relative to said housing and removal and replacement thereof regardless of how tightly the coupling is screwed onto the supply line.

4. The spray tip assembly of claim 3 including an annular resilient sealing member interposed between a downstream end of said seal adapter and an upstream of said seal.

5. A spray tip assembly for mounting on the end of a liquid supply line for receiving pressurized liquid from said supply line and for discharging a liquid spray comprising a housing having a longitudinal bore and a transverse bore intersecting said longitudinal bore;

coupling means for releasably securing said housing to said supply line for permitting communication of liquid from said supply line to said longitudinal bore;

a cylindrical turret rotatably and removably supported in said transverse bore and having a through bore that is positionable into aligned relation with said longitudinal housing bore;

means in said turret through bore defining a spray orifice from which a liquid spray discharges;

an annular floating seal slidably positioned in said longitudinal housing bore and having a cylindrically concave sealing face adapted for sealing engagement with said turret about an upstream side of said turret through bore;

an annular seal adapter disposed in said longitudinal housing bore upstream of said seal, said annular seal adapter, annular seal, and spray orifice defining means forming a liquid flow passageway through said spray tip assembly;

said seal adapter having a portion extending outwardly of said housing on an upstream side thereof such that upon securing said housing to a supply line by said coupling means an axial force is exerted on said seal adapter which urges said seal adapter into said longitudinal housing bore and in turn exerts an axial force on said floating seal for biasing said floating seal into initial sealing engagement with said turret; and said seal adapter having means for limiting movement of said seal adapter into said longitudinal housing bore during securement of said housing to said supply line by said coupling means for precisely establishing a predetermined position of said seal adapter in said longitudinal housing bore and hence a predetermined initial biasing force of the seal adapter against said turret which permits rotation of said turret relative to said housing and removal and replacement of the turret without releasing said coupling means regardless of how tightly said coupling secures said housing to said supply line and regardless of the magnitude of the axial force that is exerted on said seal adapter.

6. The spray tip assembly of claim 5 in which said coupling means is a threaded coupling member rotatably supported by said housing for engagement with a threaded end of said supply line.

7. The spray tip assembly of claim 5 in which said annular floating seal has an upstream end exposed to line pressure which additionally urges said sealing member into sealing contact with said turret upon communication of high pressure liquid through said liquid flow passageway during spraying.

8. The spray tip assembly of claim 7 including a sealing gasket interposed between an upstream end of said seal adapter and a downstream end of said supply line.

9. The spray tip assembly of claim 5 in which said housing is formed with an annular lip extending inwardly into said longitudinal bore adjacent an upstream side of said transverse bore for limiting downstream longitudinal positioning of said seal in said longitudinal bore.

10. The spray tip assembly of claim 5 in which said orifice defining means is an orifice tip mounted in said turret transverse bore.

11. A spray tip assembly for mounting on the threaded end of a liquid supply line for receiving pressurized liquid from said supply line and for discharging a liquid spray comprising a housing having a longitudinal bore and a transverse bore intersecting said longitudinal bore;

coupling means for releasably securing said housing to said supply line for permitting communication of liquid from said supply line to said longitudinal bore;

a cylindrical turret rotatably and removably supported in said transverse bore and having a through bore that is positionable into aligned relation with said longitudinal housing bore;

means in said turret through bore defining a spray orifice from which a liquid spray discharges;

an annular floating seal slidably positioned in said longitudinal housing bore and having a cylindrically concave sealing face adapted for sealing engagement with said turret about an upstream side of said turret through bore;

an annular seal adapter disposed in said longitudinal housing bore upstream of said floating seal, said annular seal adapter, annular seal, and spray orifice defining means forming a liquid flow passageway through said spray tip assembly;

said seal adapter having a portion extending outwardly of said housing on an upstream side thereof, said coupling means including a threaded coupling member rotatably supported by said housing for engagement with the threaded end of said supply line such that upon tightening of said coupling member onto said threaded end axial forces are exerted on the upstream end of said seal adapter and in turn on said floating seal for biasing said floating seal into initial sealing engagement with said turret; and and said seal adapter having an outwardly extending radial flange formed on the upstream end thereof for engagement with an upstream side of said housing when said coupling member is threaded onto said supply line for limiting the initial biasing force of the seal adapter against said turret during securement of said housing to said supply line by said coupling means to a level that permits rotation of said turret relative to said housing and removal and replacement of the turret without releasing said coupling means.

12. The spray tip assembly of claim 11 including an annular resilient sealing member interposed between a downstream end of said seal adapter and an upstream end of said seal.

13. The spray tip assembly of claim 12 in which said sealing member is an O-ring.

14. A spray tip assembly for mounting on the end of a liquid supply line for receiving pressurized liquid from said supply line and for discharging a liquid spray comprising a housing having a longitudinal bore and a transverse bore intersecting said longitudinal bore;

coupling means for releasably securing said housing to said supply line for permitting communication of liquid from said supply line to said longitudinal bore;

a cylindrical turret rotatably and removably supported in said transverse bore and having a through bore that is positionable into aligned relation with said longitudinal housing bore;

means in said turret through bore defining a spray orifice from which a liquid spray discharges;

an annular floating seal slidably positioned in said longitudinal housing bore and having a cylindrically concave sealing face adapted for sealing engagement with said turret abut an upstream side of said turret through bore;

an annular seal adapter disposed in said longitudinal housing bore upstream of said seal, said annular seal adapter, floating seal, and spray orifice defining means forming a liquid flow passageway through said spray tip assembly;

said seal adapter having a portion extending outwardly of said housing on an upstream side thereof such that upon securing said housing to a supply line by said coupling means an axial force is exerted on said seal adapter and in turn on said floating seal for biasing said floating seal into initial sealing engagement with said turret;

said seal adapter having means for limiting the initial biasing force of the floating seal against said turret during securement of said housing to said supply line by said coupling means to a level that permits rotation of said turret relative to said housing and removal and replacement of the turret without releasing said coupling means;

an annular a resilient O-ring sealing member interposed between a downstream end of said seal adapter and an upstream end of said floating seal; and said seal adapter having an annular lip extending from a downstream end thereof for supporting said O-ring adjacent an outer periphery of the upstream end of said seal.

* * * * *